US005824115A

United States Patent [19]

Kubota et al.

[11] Patent Number: 5,824,115

[45] Date of Patent: Oct. 20, 1998

[54] METHOD FOR IMPROVING CELLULOSE FIBER

[75] Inventors: Yuichi Kubota, Wakayama; Eiichi Hoshino; Koji Aigami, both of Tochigi, all of Japan

[73] Assignee: Kao Corporation, Tokyo, Japan

[21] Appl. No.: 750,037

[22] PCT Filed: Apr. 5, 1996

[86] PCT No.: PCT/JP96/00941

§ 371 Date: Nov. 27, 1996

§ 102(e) Date: Nov. 27, 1996

[87] PCT Pub. No.: WO96/31645

PCT Pub. Date: Oct. 10, 1996

[30] Foreign Application Priority Data

Apr. 6, 1995 [JP] Japan ..... 7-081265

[51] Int. Cl.[6] ..... D06M 3/388; D06M 11/13

[52] U.S. Cl. ..... 8/194; 8/196; 8/181; 8/116.1; 106/163.01; 536/56; 427/394; 427/396

[58] Field of Search ..... 8/194, 196, 181, 8/116.1; 106/163.01; 536/56; 252/8.86; 510/276, 337, 338; 427/394, 396

[56] References Cited

U.S. PATENT DOCUMENTS

| | | | |
|---|---|---|---|
| 2,060,568 | 11/1936 | Graenacher et al. | 8/127 |
| 3,001,945 | 9/1961 | Drew et al. | 510/433 |
| 3,202,714 | 8/1965 | Zimmerer et al. | 564/297 |
| 3,953,382 | 4/1976 | Nelson et al. | 510/346 |

FOREIGN PATENT DOCUMENTS 60-28848 7/1985 Japan .

OTHER PUBLICATIONS

Swelling Behaviour of Cellulose by Chemical and Mechanical Treatments, vol. 48. No. 9 (1992), Akira Isogal et al, p. 487 (month unknown).

*Primary Examiner*—Alan Diamond

*Attorney, Agent, or Firm*—Birch, Stewart, Kolasch & Birch, LLP

[57] ABSTRACT

A cellulose fiber is immersed in a cellulose fiber dissolving agent such as tertiary amine-N-oxide, lithium chloride/N,N-dimethylacetoamide or N-methylmorpholine-N-oxide under conditions where the dissolving agent does not dissolve the cellulose fiber. Therefore, the water absorbing property and moisture absorbing and discharging property of the cellulose fiber can be improved without deteriorating the strength and feeling of the cellulose fiber.

2 Claims, No Drawings

METHOD FOR IMPROVING CELLULOSE FIBER

This application is a 371 of PCT/JP96/00941 filed Apr. 5, 1996.

FIELD OF THE INVENTION

This invention relates to a method for improving a cellulose fiber which is characterized in that, the cellulose fiber is treated with a cellulose dissolving agent which may dissolve a cellulose fiber and with mild conditions where the fiber can not be dissolved therewith, which can improve the water absorbing property and moisture absorbing and discharging property of the fiber without impairing the natural feeling of a cellulose fiber and without embrittling the fiber.

PRIOR ART

Cellulose fibers have been popular for a long time because of their natural feeling and high hydrophilic nature and are still used as most of clothing materials even nowadays which sees the growth of chemical fibers. A wide variety of functions, not only water absorbing ability but also moisture absorbing and discharging ability and the like are required for clothing materials or household goods such as towels. It is known that moisture absorbing and discharging ability plays an important role in adjusting humidity inside clothes and temperature inside clothes at the same time.

It has been attempted to improve the hydrophilic property of a cellulose fiber by introducing a carboxyl group or other hydrophilic substituent or by carrying out a cellulase treatment.

It has been, however, reported that they have such problems as that the natural feeling of a cellulose fiber is impaired by introducing such a substituent and that the fiber strength is reduced by a cellulase treatment.

For instance, "SEN-I GAKKAISHI (the Bulletin of the Fiber Society), Vol.48 (9), page 487 (1992)" discloses that the crystallinity of cellulose is reduced and water retentivity is improved by treating with a specific cellulose solvent. Since, however, "the treatment is carried out so as to the crystallinity is reduced", there is a disadvantage of that the natural feeling, strength and the like of the fiber are impaired. JP-B-60-28848 discloses a cellulose molded article obtained by dissolving cellulose in a tertiary amine-N-oxide as a solvent, stretching and precipitating cellulose. In this case, since a cellulose fiber is completely dissolved, the fiber strength is reduced.

DESCRIPTION OF THE INVENTION

An object of the present invention is to improve the water absorbing property and moisture absorbing and discharging property of a cellulose fiber without impairing the natural feeling of the cellulose fiber and without embrittling the fiber.

The inventors of the present invention have conducted intensive studies to attain the above object, and have found that the water absorbing property and moisture absorbing and discharging property of a cellulose fiber can be improved by treating the fiber with a cellulose dissolving agent which may dissolve a cellulose fiber and with mild conditions where the fiber can not be dissolved therewith, which can improve the water absorbing property and moisture absorbing and discharging property of the fiber without impairing the natural feeling of a cellulose fiber and without embrittling the fiber. Thus, the present invention has been achieved.

The present invention relates to a cellulose fiber improved to increase the amount of bound water without changing its crystallinity and polymerization degree and without dissolving its crystalline region.

Furthermore, the present invention provides a method for improving a cellulose fiber which comprises the step of contacting a cellulose fiber with a cellulose dissolving agent under conditions where the cellulose dissolving agent can not dissolve the cellulose fiber so as to improve the water absorbing property and moisture absorbing and discharging property of the cellulose fiber. In the other word, the present invention can provide enhanced moisture discharging of a cellulose fiber, accompanied with heat discharging of human skin surface.

In the present invention, the term "cellulose dissolving agent" denotes an agent which can dissolve a cellulose fiber under specific conditions and is used in such fields as recycling and dissolution of cellulose and spinning. Conditions where a cellulose fiber may not be dissolved with such a cellulose dissolving agent can be discovered by controlling conditions such as temperature, concentration, treatment time, bath ratio and the like according to the kind of the cellulose dissolving agent. In concrete terms, the conditions include treatment at low temperatures, dilution with water or a solvent and the like. The expression "can not be dissolved" used in the present invention refers to a state that the fiber strength is not reduced substantially at all, that is, is not reduced at all or, even if it is, slightly. The term "fiber strength" used herein indicates tensile strength measured in accordance with a JIS L-1096A method (labelled strip method).

As the cellulose dissolving agent used in the present invention, known cellulose dissolving agents may be used. Illustrative examples of the cellulose dissolving agent in which cellulose functions as a base include aqueous solutions of metal salts such as potassium salt, ammonium salt, sodium salt, barium salt, manganese salt, magnesium salt, calcium salt and lithium salt dissolved in acids such as sulfuric acid, phosphoric acid, nitric acid, hydrochloric acid and hydrogen trifluoride.

Illustrative examples of the cellulose dissolving agent in which cellulose functions as an acid include quaternary ammonium base such as benzyltrimethyl ammonium hydroxide and dibenzyldimethyl ammonium hydroxide, saturated cyclic amine oxides, tertiary amine-N-oxide, hydrazine and the like.

Illustrative examples of the dissolving agent which dissolves by forming a complex with cellulose include N,N-dimethylacetoamide/lithium chloride system, copper ammonia, copper ethylene diamine, Cadxene, Nioxene, Nioxam, sodium iron tartrate, methylamine/dimethylsulfoxide system, bis(β, γ-dihydroxypropyl)-disulfide and the like.

Illustrative examples of the dissolving agent which dissolves by generating a cellulose derivative include dinitrogen tetraoxide/dimethylsulfoxide or dimethylformamide system, paraformaldehyde/dimethylsulfoxide system, anhydrous chloral/dimethylsulfoxide or dimethylformamide system, $SO_2$/secondary or tertiary amine/dimethylsulfoxide or dimethylformamide system and the like.

Among these cellulose dissolving agents, tertiary amine-N-oxide and N,N-dimethylacetoamide/lithium chloride are particularly preferred because treatment conditions by using thereof which meet the object to obtain an improving effect of the present invention are in a wide range. The strength of the improved fiber is not reduced or is reduced slightly compared with that before the improvement.

Tertiary amine-N-oxide is preferably used as an aqueous solution in a concentration of 0.1 to 60% by weight and can treat a cellulose fiber therewith at a temperature of 10° to 85° C. Although it can be used without being diluted, care must be taken in treating a cellulose fiber under conditions where the cellulose fiber can not be dissolved. Examples of the tertiary amine-N-oxide include N-methylmorpholine-N-oxide and mono-long-chain alkyl($C_4$ to $C_{14}$) di-lower-alkylamine-N-oxide, specifically, N-N-dimethyldodecylamine-N-oxide, N,N-dimethylnonylamine-N-oxide, N,N-dimethyloctylamine-N-oxide and the like. These commercial products may be used.

In the case of N,N-dimethylacetoamide/lithium chloride, a cellulose fiber can be treated in an N,N-dimethylacetoamide solution which dissolves 0.1 to 8% by weight of lithium chloride at a temperature of 10° to 85° C. Tertiary amine-N-oxide or N,N-dimethylacetoamide/lithium chloride is preferred as the cellulose dissolving agent used in the present invention because of easy handing.

In the present invention, a cellulose fiber is generally immersed in a dissolving agent, but its immersion time is not limited and may be several minutes to, if necessary, several days. Although the above cellulose dissolving agents have been used to dissolve a conventional cellulose fiber and put it to various applications as described above, conditions for dissolving a cellulose fiber are limited to very narrow ranges and severe conditions such as high concentration, high temperature, low bath ratio and a long treatment time have generally been required. In the present invention, however, a cellulose fiber is treated with a cellulose dissolving agent under not such severe conditions but mild conditions that do not dissolve the cellulose fiber, whereby a totally unexpected effect can be obtained that the water absorbing property and moisture absorbing and discharging property of the cellulose fiber can be improved without deteriorating the natural feeling and strength of the cellulose fiber.

Although the mechanism of developing the effect of improving a cellulose fiber according to the present invention is not completely identified, it is considered that the effect is caused by various changes in the fine structure of a cellulose fiber amorphous region, and that all solvents having an ability to dissolve a cellulose fiber can be used in the present invention since such solvent may cause this structural change of amorphous region. Therefore, the present invention does not limit type of the cellulose dissolving agent at all.

The present invention can be used in the treatment of a cellulose fiber used for various applications that require high water absorbing property and moisture absorbing and discharging property, for example, underwear materials, towels and sweat sportswear materials. The form of the fiber is not limited, and the improving method of the present invention can be applied to any of pulp, yarn, paper, non-woven mat (sheet), cloth and any fiber products.

According to the present invention, the water absorbing property and moisture absorbing and discharging property of a cellulose fiber can be improved without impairing the natural feeling of the cellulose fiber and without embrittling the fiber. In addition, a treatment effect can be obtained from the method of the present invention for any type of a cellulose fiber, riot only for natural fibers such as cotton and hemp but also for regenerated cellulose such as rayon and Tencel.

EXAMPLES

The following examples are given to further illustrate the present invention. However, it is understood that the present invention is not limited to these examples.

Example 1

Water Absorbing Property

Three different cellulose fibers were prepared.

1) cotton plain woven cloth: a plain woven cloth obtained from the Senshiyoku Shizai Co. (Osaka, Japan) (cotton shirting, bleached cotton A-2),
2) cotton towel: a commercial product,
3) rayon plain woven cloth: a plain woven cloth obtained from Senshiyoku Shizai Co. (Osaka, Japan).

To remove a treatment agent, fibers which have been pre-treated (cumulatively washed five times with a commercial powdery heavy-duty detergent) were applied to experiments.

Five different cellulose dissolving agents were prepared.

a) N-methylmorpholine-N-oxide (Aldrich),
b) N,N-dimethyldodecylamine-N-oxide (Aldrich),
c) N,N-dimethylnonylamine-N-oxide (Aldrich),
d) N,N-dimethyloctylamine-N-oxide (Aldrich), and
e) N,N-dimethylacetoamide/lithium chloride (Wako).

Aqueous solutions of 1.7% by weight, 15% by weight and 30% by weight were prepared for each above cellulose dissolving agents a) to d), and the fiber was immersed in the solution at 30° C. for 15 minutes. Thereafter, the fiber was fully washed by water, dried by air indoors, left to stand at 20° C. and an relative humidity (RH) of 65% for 24 hours, and applied to water absorbing property test.

For the cellulose dissolving agent e), each fiber was stirred and immersed in an N,N-dimethylacetoamide solution which dissolves 4% by weight of lithium chloride at a temperature of 20° to 60° C. for 15 minutes. Thereafter, the fiber underwent the same process as that for the cellulose dissolving agents a) to d) and applied to water absorbing property test.

In any case, the amount of the solution was adjusted so that each fiber was completely immersed in the solution.

The water absorption test method was in accordance with a JIS L-1096 water absorbing rate B method (Byrex method). In concrete terms, five 20×2.5 cm test pieces were prepared from each sample treated by the above method in each of vertical and horizontal directions, and each test piece was pinned on a horizontal bar which was held at a certain height from a water tank filled with water of 20°±2° C. The bottom end of the test piece was aligned and the horizontal bar was lowered so that the bottom end of the test piece was immersed in water. The height of water absorbed up by each test piece in 10 minutes was measured. The test was carried out five times in each of vertical and horizontal directions and the results thereof were shown by an average (cm) of each five measured values. The results are given in Table 1.

TABLE 1

| | fiber | Water absorption height (cm) | | | | | |
|---|---|---|---|---|---|---|---|
| | | cotton plain woven cloth | | cotton towel | | rayon plain woven cloth | |
| | dissolving agent | vertical | horizontal | vertical | horizontal | vertical | horizontal |
| a) | 1.7 wt. % | 10.3 | 10.8 | 18.2 | 18.0 | 6.7 | 6.3 |
| | 15 wt. % | 10.7 | 11.2 | 18.2 | 18.0 | 6.9 | 6.9 |
| | 30 wt. % | 10.0 | 10.5 | 18.2 | 18.0 | 6.6 | 6.9 |
| b) | 1.7 wt. % | 11.3 | 11.7 | 20.5 | 20.2 | 7.1 | 7.1 |
| | 15 wt. % | 10.3 | 10.6 | 20.7 | 20.6 | 7.1 | 7.2 |
| | 30 wt. % | 10.3 | 10.3 | 20.4 | 20.8 | 7.2 | 7.1 |
| c) | 1.7 wt. % | 9.3 | 10.0 | 18.9 | 18.9 | 6.3 | 6.3 |
| | 15 wt. % | 9.9 | 10.0 | 18.9 | 19.2 | 6.3 | 6.3 |
| | 30 wt. % | 9.1 | 10.1 | 18.3 | 18.7 | 6.3 | 6.3 |
| d) | 1.7 wt. % | 9.1 | 9.1 | 18.7 | 18.5 | 6.2 | 6.4 |
| | 15 wt. % | 9.2 | 9.5 | 18.9 | 18.6 | 6.1 | 6.1 |
| | 30 wt. % | 9.2 | 9.4 | 18.8 | 18.1 | 6.0 | 6.1 |
| e) | 20° C. | 12.5 | 12.7 | 19.1 | 18.7 | 7.8 | 7.9 |
| | 40° C. | 13.0 | 13.8 | 19.0 | 19.0 | 7.5 | 7.6 |
| | 60° C. | 14.0 | 14.4 | 18.7 | 18.2 | 7.6 | 7.5 |
| | control (untreated cloth) | 8.0 | 8.5 | 18.2 | 18.0 | 5.5 | 5.6 |

As shown in the above, water absorbing rate is significantly improved in all of the cellulose dissolving agents and the cellulose fibers, compared with an untreated cloth (control).

Example 2

Moisture Absorbing and Discharging Property

Moisture Absorbing Rate

Each sample treated in the same manner as in Example 1 was left to stand at 30° C. and an RH of 55% for 24 hours. Under the same conditions, each sample was measured for its weight and moved immediately to under conditions of a temperature of 30° C. and an RH of 85% to determine its weight increase rate (moisture absorbing rate) after 5 minutes.

$$\text{Moisture absorbing (\% by weight)} = \frac{\text{(weight after 5 min.)} - \text{(weight under initial conditions)}}{\text{weight under initial conditions}} \times 100 \quad \text{[Formula 1]}$$

Moisture Discharging Rate

To measure moisture discharging rate, each sample was left to stand at 30° C. and an RH of 85% for 24 hours and measured for its weight under the same conditions. Thereafter, it was moved immediately to under conditions of a temperature of 30° C. and an RH of 55% and determined its weight reduction rate (moisture discharging rate) after 5 minutes.

$$\text{Moisture discharging rate (\% by weight)} = \frac{\text{(weight under initial conditions)} - \text{(weight after 5 min.)}}{\text{weight under initial conditions}} \times 100 \quad \text{[Formula 2]}$$

The results are given in Table 2.

TABLE 2

| | fiber | Moisture absorbing and discharging rate (% by weight) | | | | | |
|---|---|---|---|---|---|---|---|
| | | cotton plain woven cloth | | cotton towel | | rayon plain woven cloth | |
| | dissolving agent | moisture absorbing rate | moisture discharging rate | moisture absorbing agent | moisture discharging rate | moisture absorbing rate | moisture discharging rate |
| a) | 1.7 wt. % | 2.8 | 3.9 | 4.8 | 5.6 | 4.2 | 5.9 |
| | 15 wt. % | 2.8 | 3.8 | 5.1 | 5.3 | 4.1 | 6.1 |
| | 30 wt. % | 2.4 | 3.6 | 4.9 | 5.4 | 4.2 | 6.0 |
| b) | 1.7 wt. % | 2.9 | 4.1 | 4.9 | 5.7 | 4.3 | 6.0 |
| | 15 wt. % | 2.8 | 4.2 | 5.6 | 5.1 | 4.2 | 5.8 |
| | 30 wt. % | 2.7 | 3.9 | 4.8 | 5.2 | 4.4 | 5.9 |
| c) | 1.7 wt. % | 2.3 | 3.7 | 3.8 | 4.9 | 4.7 | 6.1 |
| | 15 wt. % | 2.8 | 3.7 | 3.7 | 4.8 | 4.7 | 6.4 |
| | 30 wt. % | 2.6 | 3.7 | 3.5 | 4.8 | 4.6 | 6.3 |
| d) | 1.7 wt. % | 2.0 | 3.5 | 3.3 | 4.5 | 4.7 | 6.7 |
| | 15 wt. % | 2.2 | 3.6 | 3.4 | 4.4 | 4.3 | 6.8 |
| | 30 wt. % | 2.2 | 3.6 | 3.4 | 4.9 | 4.3 | 6.5 |
| e) | 20° C. | 2.3 | 3.8 | 3.7 | 4.6 | 5.9 | 7.8 |
| | 40° C. | 2.3 | 3.9 | 3.8 | 4.7 | 6.3 | 7.3 |
| | 60° C. | 2.5 | 3.8 | 3.8 | 4.7 | 6.1 | 7.5 |
| | control (untreated cloth) | 1.8 | 3.4 | 2.8 | 4.1 | 3.7 | 5.1 |

As shown in the above, moisture absorbing and discharging property is significantly improved in all of the cellulose dissolving agents and the cellulose fibers, compared with an untreated cloth.

It is known from the results of Examples 1 and 2 that the feeling of wearing is further improved by the treatment of the present invention applied to a cellulose fiber, compared with an untreated one.

Example 3

Tensile Strength

The tensile strength was determined for each pretreated cellulose fiber 1) to 3) (cotton plain woven cloth, cotton towel and rayon plain woven cloth) same as those used in Example 1.

The fiber was stirred and immersed in an aqueous solution of 30% by weight, which was the highest as a treating concentration of each cellulose dissolving agent a) to d) to the cellulose fiber in Examples, at 30° C. for 15 minutes. Thereafter, the fiber was fully washed by water, dried by air indoors, left to stand at 20° C. and an RH of 65% for 24 hours, and applied to the tensile strength test. Also, in the case of the cellulose dissolving agent e), a solution was prepared in the same manner as in Example 1, the fiber was stirred and immersed at 60° C. which was the highest for 15 minutes. Thereafter, the fiber underwent the same process as above and tested for its tensile strength.

The tensile strength test method was in accordance with a JIS L-1096A method (labelled strip method). In concrete terms, 2.5 cm wide test pieces were cut out from each sample treated by the above method, loaded by a fabric tensile tester and measured for its breaking strength (kgf). The result shows an average of three measurement values in each of vertical and horizontal directions. The average values are shown in Table 3.

TABLE 3

| | | Tensile strength (kgf) | | | | | |
|---|---|---|---|---|---|---|---|
| | fiber | cotton plain woven cloth | | cotton towel | | rayon plain woven cloth | |
| | dissolving agent | vertical | horizontal | vertical | horizontal | vertical | horizontal |
| a) | 30 wt. % | 25.1 | 28.2 | 20.2 | 22.6 | 21.0 | 15.5 |
| b) | 30 wt. % | 25.1 | 28.7 | 20.6 | 22.5 | 21.1 | 16.2 |
| c) | 30 wt. % | 25.1 | 28.9 | 21.1 | 22.6 | 20.3 | 16.1 |
| d) | 30 wt. % | 25.0 | 28.3 | 20.0 | 22.6 | 20.6 | 17.3 |
| e) | 60° C. | 26.1 | 28.1 | 21.2 | 22.6 | 19.8 | 15.8 |
| | untreated cloth | 25.1 | 28.5 | 20.3 | 22.5 | 20.3 | 15.7 |

As shown in Table 3, all of the tensile strength of the cellulose fiber treated with a cellulose dissolving agent according to the present invention is the same as that of an untreated cloth, that is, cellulose fibers and that the fibers are not embrittled by the treatment of the present invention.

Example 4

Comparison of Feeling

Cotton towels treated at the highest concentration, samples a) to d), and at the highest temperature, sample e), were used as in Example 3. Each sample was dried by air indoors and left to stand in an air-conditioned room at 20° C. and an RH of 65% for 24 hours. Thereafter, each sample was compared with an untreated cloth as a control and evaluated in feeling by the sensory judgement based on the following criteria. The results are shown in Table 4.

Criterion of Evaluation

+2 Clearly superior to the control in feeling
+1 Considerably superior to the control in feeling
0 Nearly equal to the control in feeling
−1 Considerably inferior to the control in feeling
−2 Clearly inferior to the control in feeling

TABLE 4

| Dissolving agent | Sensory judgement |
|---|---|
| a) 30 wt. % | 0 |
| b) 30 wt. % | 0 |
| c) 30 wt. % | 0 |
| d) 30 wt. % | 0 |
| e) 60° C. | 0 |

It is shown that feeling, i.e., the results of the sensory judgement, is the same as that of an untreated cloth in treatments with all of the cellulose dissolving agents and that the natural feeling of cotton is not impaired by the treatment of the present invention.

Since each fiber was dissolved by the same treatment with the method of Turbak, A. F. (Tappi, vol. 67, pages 94 to 96, 1984), tensile strength and feeling could not be measured.

What is claimed is:

1. A method for improving the water absorbing and moisture absorbing and discharging properties of a cellulose fiber, which comprises bringing the cellulose fiber into contact with a cellulose dissolving agent which is a mixture of N,N-dimethylacetoamide and lithium chloride under conditions where the cellulose fiber can not be dissolved with said agent thereby improving the water absorbing property and moisture absorbing and discharging property of the cellulose fiber.

2. A method for improving the water and moisture absorbing and discharging properties of a cellulose fiber which comprises bringing the cellulose fiber into contact with a cellulose dissolving agent which is a mixture of 0.1 to 8% by weight of lithium chloride dissolved in N,N-dimethyl acetoamide and wherein said bringing said cellulose fiber into contact with said dissolving agent occurs at a temperature in a range of 10° to 80° C.

* * * * *